US005096078A

United States Patent [19]

McQueeny

[11] Patent Number: 5,096,078

[45] Date of Patent: Mar. 17, 1992

[54] TAMPER-EVIDENT CLOSURE ASSEMBLY

[75] Inventor: Thomas P. McQueeny, Chicago, Ill.

[73] Assignee: Murrie White Drummond Lienhart & Associates, Chicago, Ill.

[21] Appl. No.: 538,159

[22] Filed: Jun. 14, 1990

[51] Int. Cl.[5] ..... B65D 51/26

[52] U.S. Cl. ..... 215/231; 215/262; 215/269; 215/270; 220/232; 220/256; 206/522; 206/524.8; 206/528

[58] Field of Search ..... 215/231, 262, 269, 270, 215/271; 220/256, 85 B, 232; 206/521, 522, 524.8, 528, 548, 594

[56] References Cited

U.S. PATENT DOCUMENTS

| | | | |
|---|---|---|---|
| 288,603 | 11/1883 | von Schlieffen . | |
| 447,974 | 3/1891 | Rheinstrom . | |
| 2,040,798 | 5/1936 | Schoonmaker . | |
| 2,833,398 | 5/1958 | Marshall | 215/231 X |
| 2,880,900 | 4/1959 | Foye | 215/231 |
| 3,343,701 | 9/1967 | Mahoney . | |
| 3,396,864 | 8/1968 | Jones et al. . | |
| 3,863,795 | 2/1975 | Mills . | |
| 4,215,786 | 8/1990 | Vertes . | |
| 4,392,578 | 7/1983 | Fipp et al. . | |
| 4,482,072 | 11/1984 | Hankins . | |
| 4,640,428 | 2/1987 | Chang | 215/270 |
| 4,684,033 | 8/1987 | Marcus . | |
| 4,798,302 | 1/1989 | Killestijn | 215/271 |
| 4,998,638 | 3/1991 | Kawamata | 220/626 |

FOREIGN PATENT DOCUMENTS

| | | | |
|---|---|---|---|
| 553190 | 2/1958 | Canada | 215/231 |
| 2628296 | 12/1977 | Fed. Rep. of Germany | 215/231 |
| 1488306 | 6/1967 | France | 215/231 |

*Primary Examiner*—Stephen Marcus
*Assistant Examiner*—Stephen Cronin
*Attorney, Agent, or Firm*—Dressler, Goldsmith, Shore, Sutker & Milnamow, Ltd.

[57] ABSTRACT

A closure assembly for a container which includes an air-impervious diaphragm which when subjected to differential pressure will expand to retain articles in place within a container. The diaphragm is retained in position by a ring member that secures the marginal portions of the diaphragm in position. the diaphragm may be secured to a container filled in a vacuum chamber so that atmospheric pressure will extend the diaphragm into the desired position or it may be subject to high pressure air to extend the diaphragm. Means for exhausting the high pressure air or for admitting atmospheric air into the interior of the container for facilitating removal of the closure assembly from the container are also described.

4 Claims, 4 Drawing Sheets

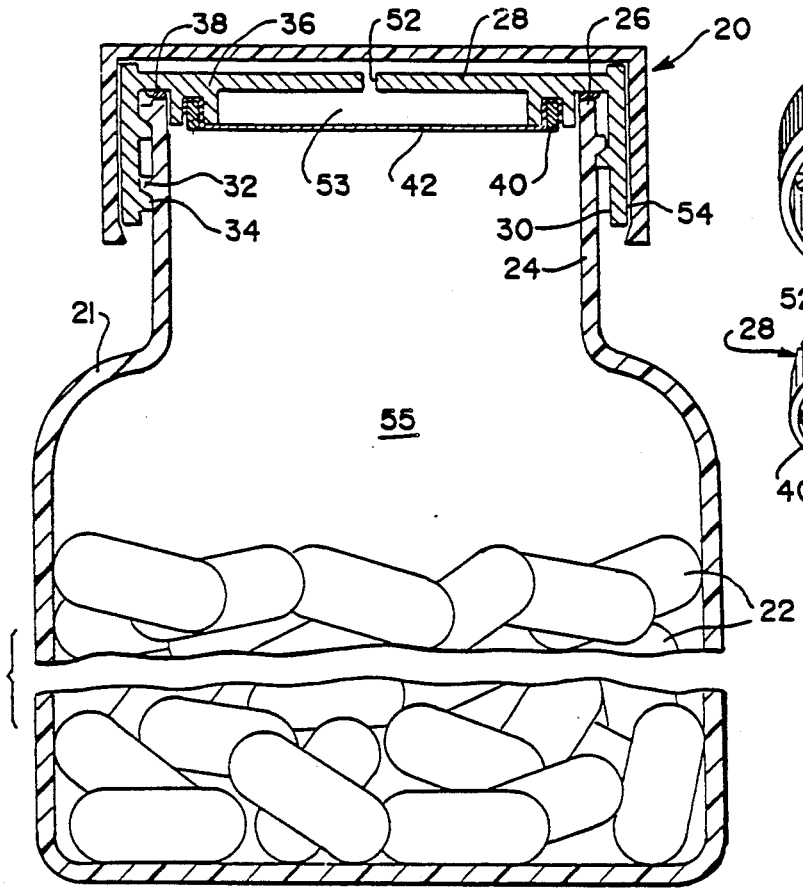
Fig. 1
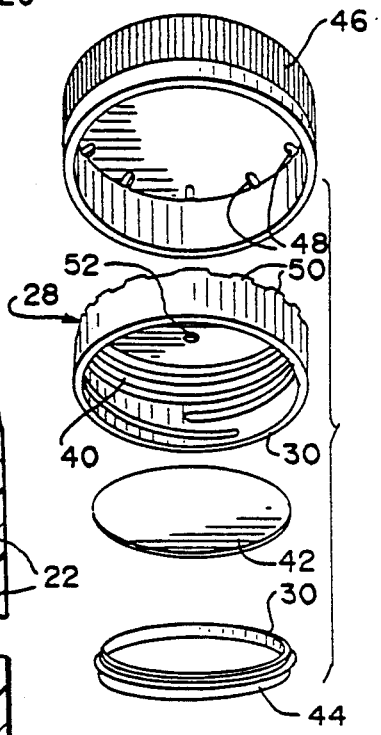
Fig. 3
Fig. 2
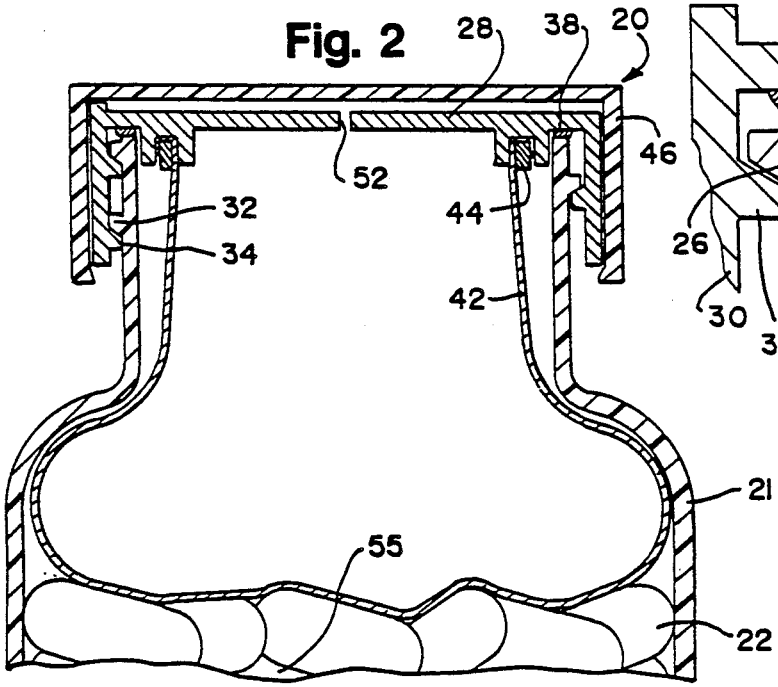
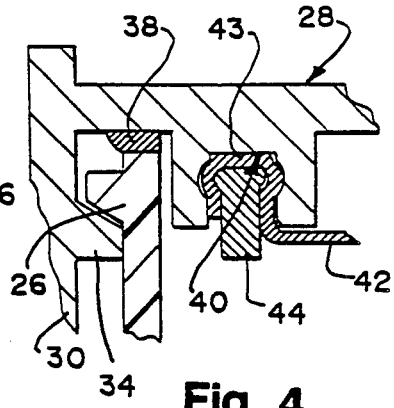
Fig. 4

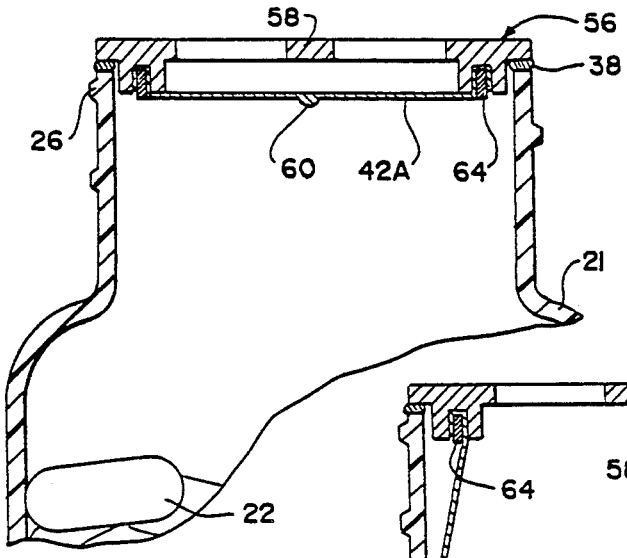
Fig. 5
Fig. 6
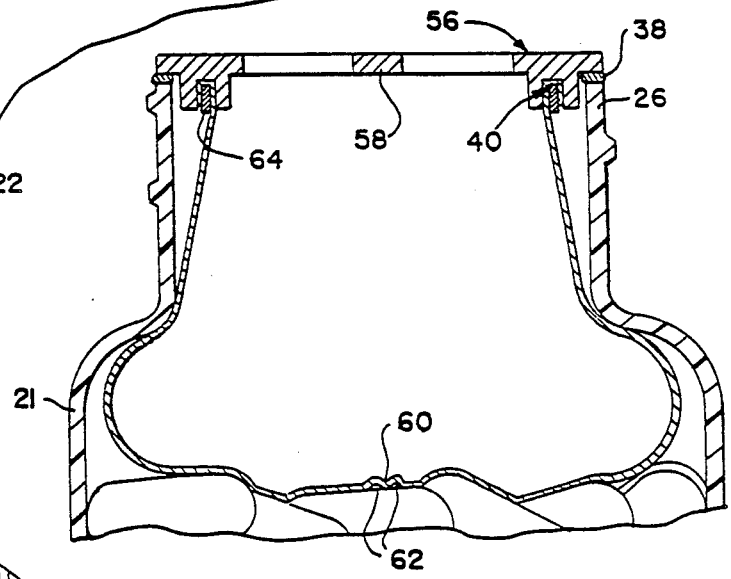
Fig. 7
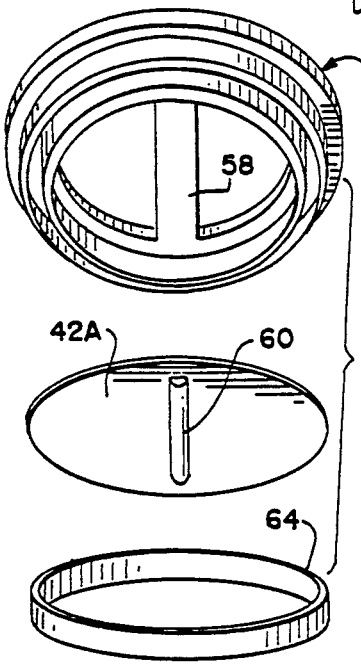
Fig. 8
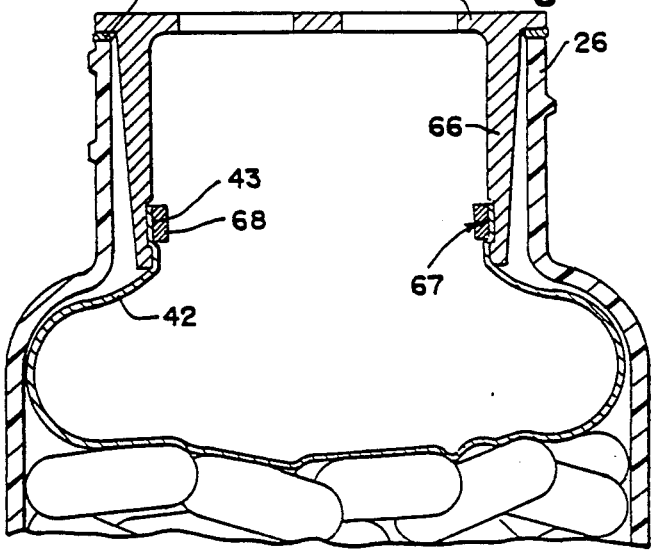

TAMPER-EVIDENT CLOSURE ASSEMBLY

FIELD OF THE INVENTION

This invention relates to a container closure assembly and particularly to a closure assembly to be used on containers in which solid articles are packed. In a typical container, such as one containing tablets or capsules, after a predetermined amount of product has been placed in the container, sterile cotton or some other type of packing material is inserted through the neck of the container to retain the articles in place to prevent relative movement therebetween.

BACKGROUND OF THE INVENTION

There have been closure assemblies for containers that have employed various types of arrangements for insuring that loose articles in a container do not move around during storage, shipping and handling. These have included various types of packing material. Expandable sealing devices have also been suggested for use. Examples of closure assemblies incorporating diaphragms or other expandable sealing devices include those shown in U.S. Pat. Nos. 2,880,900, 2,833,398 and 4,215,786. The closure industry has been continuously looking for closure assemblies that are simple and efficient to construct and use, as well as ones which will instantly indicate whether or not they have been tampered with. It would therefore be desirable to provide improved tamper-evident closure assemblies.

SUMMARY OF THE INVENTION

In accordance with the present invention, a closure assembly is provided that incorporates a resilient, stretchable diaphragm against which a differential pressure is applied to expand the diaphragm into contact with the articles located in the container to prevent movement thereof. The differential pressure applied to the diaphragm can either be by way of a positive pressure to urge the diaphragm against the articles or exposing the container to vacuum in a vacuum chamber, following which the closure assembly is sealingly engaged with the container. When atmospheric air is admitted to act on the outside of the diaphragm after the sealed container is removed from the vacuum chamber, the diaphragm will expand against the articles in the container. In either event, when so used the arrangement prevents the articles from moving around relative to each other unless and until the closure assembly has been removed from the container or the diaphragm has been permitted to relax. Thus, this construction serves as a tamper-evident feature because, if the container has been opened, shaking of the container will permit movement of the articles and thus warn the user that the container may have been opened. Once the closure is open, the differential pressure acting against the diaphragm no longer exists, and the diaphragm will resiliently return to its unexpanded position with the result that the articles are free to move about within the space left by the contracted diaphragm.

In one embodiment of the instant invention, the container is sealed under vacuum, for example in a conventional mechanical vacuum closing machine. Upon removal of the container therefrom and exposure of the container to ambient air, atmospheric pressure acting against the diaphragm will force the diaphragm to expand into contact with the articles. In one embodiment, atmospheric air is introduced above the diaphragm by providing a small hole in the cap member to which the diaphragm is secured. When the overcap is connected to the container by a threaded engagement, there is sufficient space between the cap member and the overcap to permit atmospheric air to flow therebetween and through the opening in the cap member to force the diaphragm inwardly, i.e., to expand it against the articles in the container.

In one embodiment of the present invention, the closure assembly consists of a cap member which includes an annular recess in which the marginal portions of an elastomeric diaphragm is secured. The cap member is sealed to the finish of the bottle after a vacuum has been drawn in the container through conventional vacuum means. An overcap is subsequently placed over the cap member with space being provided for air to enter into the space above the diaphragm to expand the diaphragm to engage the articles in the container thus essentially sealing the articles in a vacuum chamber internally of the container.

Other embodiments include different arrangements for securing the diaphragm in place and also include a closure assembly which operates by the introduction of a positive pressure against the diaphragm to force it against the articles in the container which is at atmospheric, rather than subatmospheric, pressure. That closure is provided with a one-way valve to permit the introduction of high pressure air and with a release valve mechanism to release the air to permit the diaphragm to move back into its unextended position which signifies that access has been had to the container contents.

Further objects, features and advantages of the invention will be seen from the accompanying specification and drawings.

BRIEF DESCRIPTION OF THE DRAWINGS

FIG. 1 shows a closure assembly of a first embodiment of the present invention with a diaphragm in its relaxed position prior to drawing a vacuum in the container;

FIG. 2 is a view like FIG. 1 wherein the container is under vacuum and the diaphragm is in its extended position;

FIG. 3 is an exploded view of the closure assembly shown of FIG. 1;

FIG. 4 is a partial enlarged sectional view of FIG. 1 showing a preferred manner in which the diaphragm is retained in position relative to the cap member;

FIG. 5 is a view similar to FIG. 1 and shows a further embodiment of a cap member portion of a closure assembly of the present invention;

FIG. 6 is a view like FIG. 5 and shows the diaphragm in the extended position after the introduction of vacuum into the container;

FIG. 7 is an exploded view of the cap member portion of FIG. 5;

FIG. 8 is a view similar to FIG. 5 wherein the cap member portion of a closure assembly is deep skirted, the lower end of which is connected to the diaphragm;

DETAILED DESCRIPTION OF THE PREFERRED EMBODIMENTS

Figure 9:
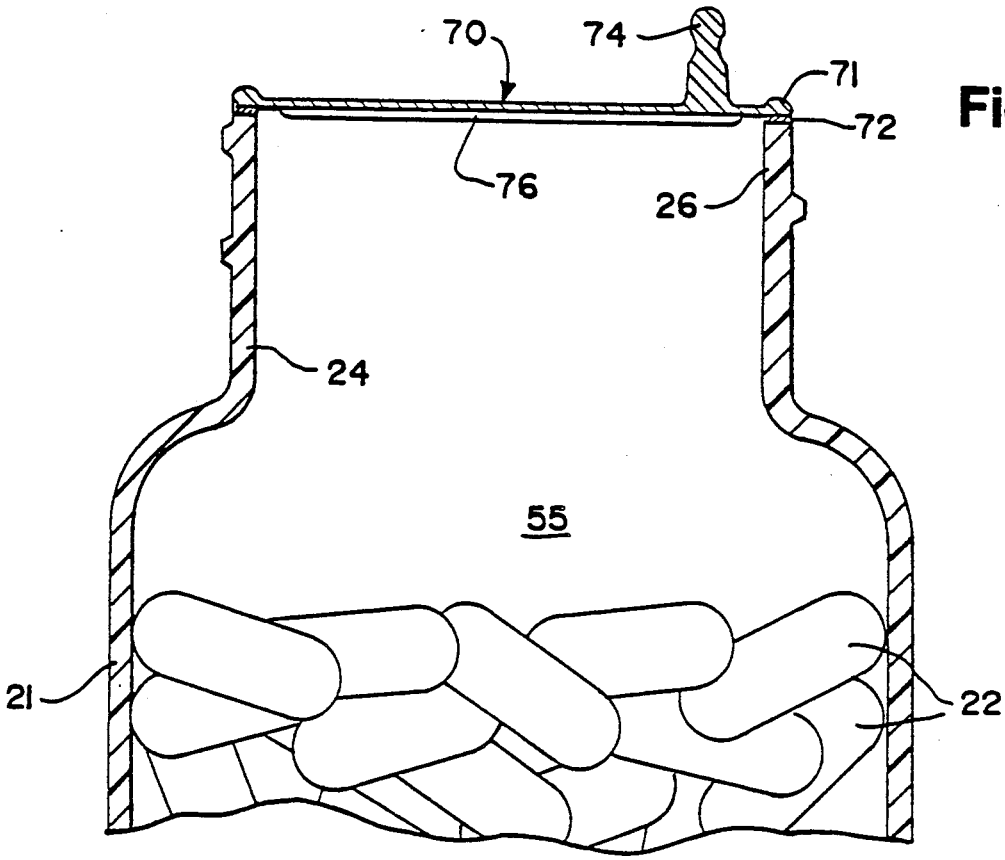
FIG. 9 illustrates another embodiment in which the diaphragm is sealed to the finish of the bottle and includes a handle extending from the diaphragm.

Referring now to FIG. 1, a closure assembly 20 is shown as being secured to a bottle or container 21 which in the illustrated embodiment may be a conventional glass or plastic container or bottle, such as a standard blow molded plastic bottle. Located within the container are articles such as tablets or capsules 22.

The neck 24 of the container 21 extends upwardly, at the upper end of which is the bottle mouth or finish 26 circumscribing an opening. Threaded to the container is a cap member 28 which includes a cap skirt portion 30 that has a cap thread 34 which is threaded to the container thread 32 when the closure assembly 20 is secured to the container.

The cap member 28 includes a radially extending flange means or portion 36 that has an annular seal 38 secured thereto adjacent its outer region. Seal 38 is positioned to provide sealing means to seal against the bottle finish 26. Seal 38 may be of a variety of known materials for providing such seals. The cap member 28 is provided with an annular recess 40 into which a marginal portion 43 of a diaphragm 42 extends. The diaphragm 42 is retained in position relative to the recess 40 and cap member 28 by a tightly fitting retaining ring 44. This and other comparable retaining rings referred to herein can be of the press-fit or snap-in type, if appropriate, as typically illustrated by FIG. 4. It can thus be seen that in the relaxed or unextended, unexpanded position, the diaphragm 42 is relatively flat and extends across substantially the full opening of the container 21. The diaphragm has an inside surface or side facing the articles 22 and an opposite outside surface or side facing outwardly of the container.

The diaphragm may be made of any material which is essentially air-impervious, extensible and somewhat resilient. There are many elastomeric substances such as natural and synthetic rubbers and plasticized resins which meet these requirements, among which are natural rubber, butadiene-styrene copolymers, butadiene-acrylonitrile copolymers, vinyl polymers, polyvinyl butyrals, and super polyesters.

A shell or overcap 46 is located over the closure cap member 28. As can be seen in FIG. 3, overcap 46 provides lugs 48 that are adapted to engage a ratchet portion 50 of the cap member 28. This requires that the overcap be pressed down against the closure member to provide engagement with the ratchet portion before the closure assembly can be removed from the container. This is a common expedient to prevent the closure from being removed by a child and may be a child-resistant feature of a closure of this invention. An opening 52 in the cap member 28 permits atmospheric air to flow into the zone or chamber 53 above the diaphragm 42 to permit the diaphragm 42 to extend to the position shown in FIG. 2 after a vacuum has been provided in the interior 55 of the container 21 below the diaphragm. A space 54 is provided between the overcap 46 and the cap member 28 which facilitates the introduction of atmospheric air into the zone 53 through the opening 52.

When the assembled closure assembly 20 and bottle 21 are to be secured to provide a tamper-evident assembly, they are positioned in a conventional vacuum chamber, vacuum is drawn, the closure is threaded to provide a seal at the bottle finish via seal 38 and the assembly is then removed from the vacuum chamber. When exposed to atmospheric pressure ambient air will force the diaphragm downwardly from the relaxed position of FIG. 1 to the expanded position of FIG. 2. This will keep the contents such as capsules 22 tightly constrained against movement until the vacuum is released. Release of the vacuum will suggest access to the contents, hence will provide evidence of tampering or access.

FIG. 4 shows in enlarged detail a snap-in connection of a marginal portion 43 of the diaphragm 42 between snap-in portions of a retaining ring 44 and complementary undercuts in the recess 40.

Referring now to FIGS. 5 to 7, another embodiment of the present invention is shown in which the cap member consists of a ring-like cap member 56 that is used with an overcap (not shown) which threads directly onto the container to retain the cap member in position. The cap member 56 has a gripping portion 58 which facilitates removal of the cap member 56 when the container is to be opened after the overcap has been removed. In this embodiment, the connection between a diaphragm 42A and the cap member 56 is comparable to that shown in FIG. 1, except that the retaining ring 64 may have a slightly different configuration than the retaining ring 44 of FIG. 1, i.e., it is shown as using a press-fit rather than a snap-in configuration relative to a recess 40. The closure assembly of FIG. 5 also differs in that the diaphragm 42A is provided with a diametrically extending bead 6 to facilitate the introduction of air into the interior 55 of the container so that the diaphragm, once in its tamper-evident position of FIG. 6, will move more quickly to the relaxed or unextended position shown in FIG. 5 and provide for ready removal of the closure assembly to open the container. While one bead 60 has been illustrated, more than one can be used.

As shown in FIG. 6, there are air spaces 62 created by the bead 60. These extend diametrically across the container, and especially where the diaphragm 2A contacts the container and its neck. As such, when the overcap is to be removed and the cap member 56 and seal 38 are moved away from the finish 26, paths for air to enter the interior of the container through spaces 62 are provided. Absent that it may sometimes be difficult to release the vacuum in the container interior.

FIG. 8 shows an embodiment similar to that of FIG. 5. In this embodiment the ring-like cap member 65 is provided with an extended skirt portion 66 wherein there is located a recess 67 adjacent the lower end for receiving the marginal portions 43 of a diaphragm 42. A retaining or snap ring 68 is located in the recess 67 to secure the diaphragm in position.

FIG. 9 shows a further embodiment of the closure assembly of the present invention. In this embodiment a diaphragm 70 is directly affixed at its marginal edge portion to an annular seal 72 which is to be secured to the finish 26 of the bottle 21. At one side of the diaphragm 70 a handle 74 is provided to facilitate removal of the diaphragm. As in all the embodiments, a shell or overcap (not shown) like that of FIG. 1 which is threadedly connected to the neck 24 of the container 21 is provided.

Figure 10:
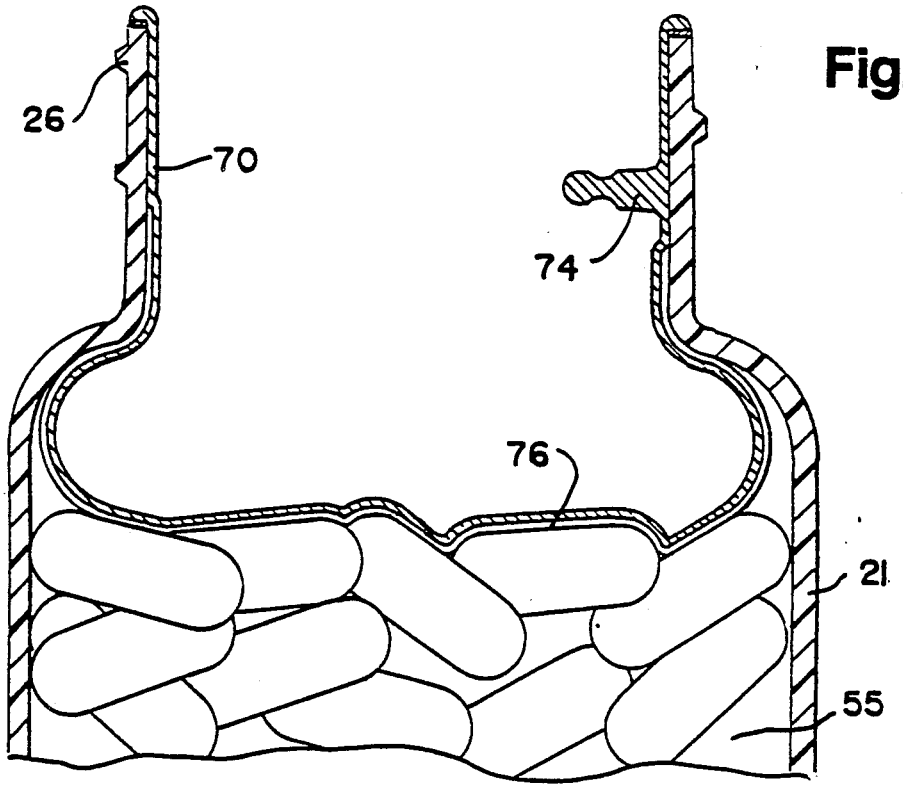
FIG. 10 is a view similar to FIG. 9 showing the diaphragm in the extended position.

As shown in FIG. 10, when the vacuum has been introduced into the interior 55 of the container 21, as in a vacuum chamber, and the diaphragm is secured as in the position of FIG. 1, and the container is removed from the vacuum chamber, the diaphragm 70 will extend to the position shown to act as a tamper-evident seal and, as in the other embodiments, as packing to prevent damage to the contents. To remove the diaphragm, thereby to gain access to the contents of the container, the handle 74 is gripped to separate the diaphragm from the finish and to allow air to be introduced into the interior 55 As in the embodiment of FIG. 5, a bead portion 76 extending diametrically across the diaphragm is provided to allow air to be more easily introduced into the container interior to facilitate return of the diaphragm to its relaxed or unextended position and thus facilitate easy opening of the container. More than one bead can be employed, if desired.

Figure 11:
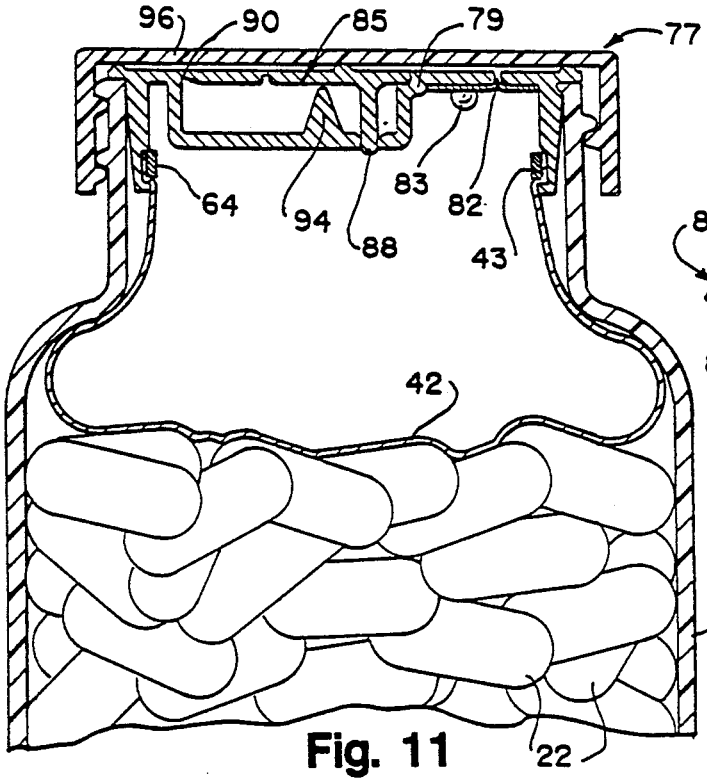
FIG. 11 is another embodiment of a closure assembly of the present invention in which there is a positive pressure applied to the diaphragm to force it into position against the articles in the container.
Figure 13:
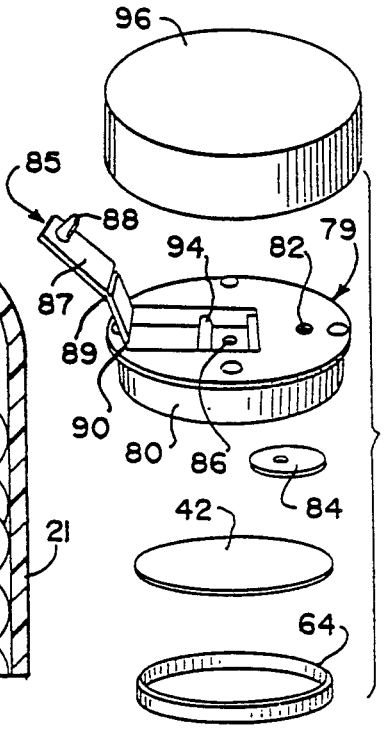
FIG. 13 is an exploded view of the closure assembly of FIG. 11.
Figure 12:
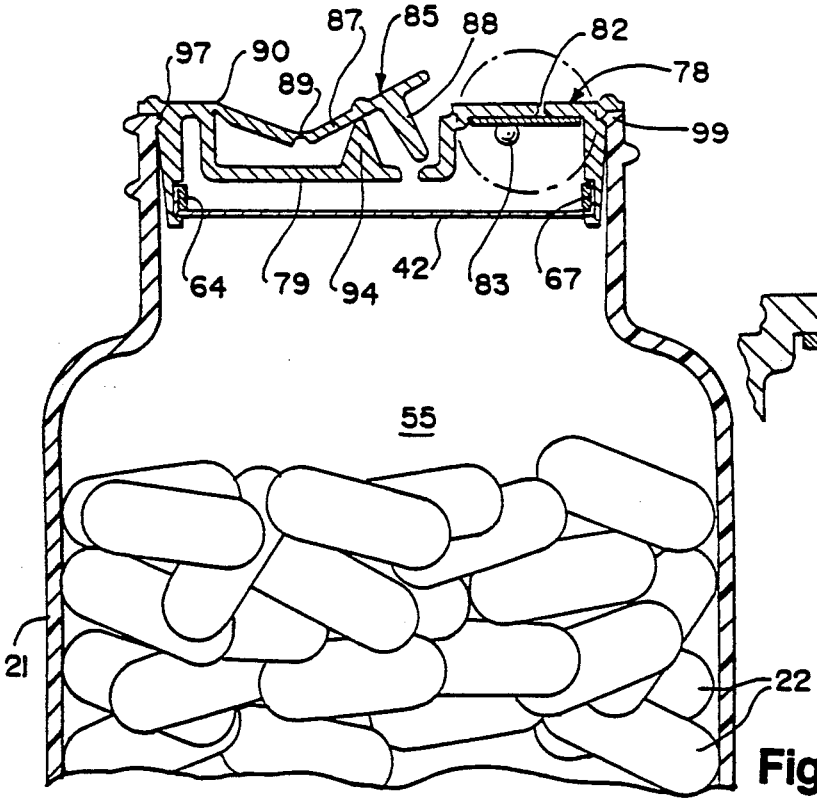
FIG. 12 is a view similar to FIG. 11 showing the pressure being vented to allow the diaphragm to return to its relaxed position.
Figure 14:
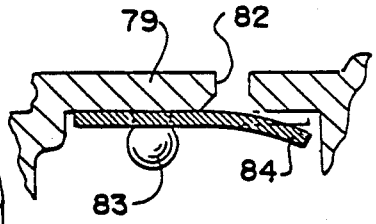
FIG. 14 is an enlarged view of the flapper valve of FIG. 11 used to admit high pressure air against the diaphragm.

A fifth embodiment of the present invention is shown in FIGS. 11 through 14. FIG. 11 shows a closure assembly 77 with the cap member assembly 78 including a diaphragm 42. Upon applying high pressure above the diaphragm, the diaphragm 42 is extended against the articles in the container 21. The cap member 79 has a skirt portion 80 which defines a recess 67 therein into which the retaining ring, such as a ring 64, is inserted to secure the marginal portions 43 of the diaphragm 42 thereto. An opening 82 is formed in the cap member 79 through which high pressure air is introduced above the diaphragm 42. This opening 82 is adapted to be closed by a one-way valve 84, shown in enlarged detail as being a flapper valve in FIG. 14. Valve 84 may be of rubber and may be secured to cap member 79 as by a mounting stud 83. After high pressure air is introduced above diaphragm 42, against its outside surface or side, it cannot escape due to the fact that the valve 84 will prevent return flow through opening 82.

In order to release the high pressure air from above the diaphragm 42, a hinged member 85 is provided. Hinged member 85 carries a plug 88 that fits into an exhaust opening 86. When it is desired to exhaust the air above the diaphragm, the hinged member 85 is moved downwardly about the hinge 90. The section 87 of the hinged member carrying the plug 88 is moved upwardly about the fulcrum 94 to raise plug 88 and to retract it from the opening 86, thereby to allow the escape of air. To facilitate movement of section 87, a weakened central section 89 is provided in the hinged member 85. When the air escapes, the diaphragm will return to the relaxed position shown in FIG. 12. The hinged member also serves as a handle to facilitate removal of the cap as may be best appreciated from FIG. 12. Other forms of air release valves may be used as well, such as glue or heat seal foil strips and the like.

The cap member 78 may be provided with an annular undercut 97 into which a rim 99 of the finish extends to hold the cap member 78 in place. An overcap 96 is located over the cap member 78.

It will be apparent to those skilled in the art that other and further embodiments and changes may be made in accordance with the present invention. Accordingly, the invention is not to be considered as being limited, except as may be necessitated in accordance with the claims.

What is claimed is:

1. A tamper-evident closure assembly for a container having an interior container wall and having a neck and opening defined by a finish portion and filled with articles, said assembly comprising a cap member having a flange portion extending radially outwardly therefrom and including sealing means to sealingly engage the finish of the container, means to prevent the movement of said articles in the container comprising an essentially air-impervious, extensible elastomeric diaphragm generally coextensive with the opening of the container, said diaphragm having an inside side facing inwardly towards said articles, an outside side and a marginal portion, means for retaining said marginal portion of said diaphragm relative to said cap member comprising means maintaining the marginal portion of the diaphragm secured to and in sealing engagement with said cap member whereby when the diaphragm is exposed to a differential pressure it is expanded to retain the articles in place in said container, and an overcap associated with said cap member and comprising means for engaging the neck of the container so as to compress said flange sealing means against said finish to form an air-tight seal, and wherein said cap member defines an annular recess in which said marginal portion of said diaphragm is disposed, and the retaining means comprises a tightly fitting ring in said recess for securing said marginal portions therein, and said cap member defining an opening for allowing atmospheric air to act against the diaphragm on its said outside side to bias the diaphragm against the articles when the diaphragm is exposed to sub-atmospheric pressure on its inside side.

2. A closure assembly as set forth in claim 1 wherein said diaphragm includes at least one diametrically extending bead on its said inside side, which, when said diaphragm is expanded to retain the article in place, defines a passage in the container along the container wall to facilitate introduction of air into said container as removal of the cap member from the container is commenced.

3. A tamper-evident closure assembly for a container having an interior container wall and having a neck and opening defined by a finish portion and filled with articles, said assembly comprising a cap member having a flange portion extending radially outwardly therefrom and including sealing means to sealingly engage the finish of the container, means to prevent the movement of said articles in the container comprising an essentially air-impervious, extensible elastomeric diaphragm generally coextensive with the opening of the container, said diaphragm having an inside side facing inwardly towards said articles, an outside side and a marginal portion, means for retaining said marginal portion of said diaphragm relative to said cap member comprising means maintaining the marginal portion of the diaphragm secured to and in sealing engagement with said cap member whereby when the diaphragm is exposed to a differential pressure it is expanded to retain the articles in place in said container, and an overcap associated with said cap member and comprising means for engaging the neck of the container so as to compress said flange sealing means against said finish to form an air-tight seal, and wherein said cap member defines a depending annular potion, an annular recess is defined in said depending annular portion, and the retaining means comprises a tightly fitting ring in said recess for securing the marginal portion of said diaphragm therein.

4. A tamper-evident closure assembly for a container having an interior container wall and having a neck and opening defined by a finish portion and filled with articles, said assembly comprising a cap member having a flange portion extending radially outwardly therefrom and including sealing means to sealingly engage the finish of the container, means to prevent the movement of said articles in the container comprising an essentially air-impervious, extensible elastomeric diaphragm generally coextensive with the opening of the container, said diaphragm having an inside side facing inwardly towards said articles, an outside side and a marginal portion, means for retaining said marginal portion of said diaphragm relative to said cap member comprising means maintaining the marginal portion of the diaphragm secured to and in sealing engagement with said cap member whereby when the diaphragm is exposed to a differential pressure it is expanded to retain the articles in place in said container, and an overcap associated with said cap member and comprising means for engaging the neck of the container so as to compress said flange sealing means against said finish to form an air-tight seal, and wherein there is provided an overcap that defines cooperating ratchet means with said cap member whereby in order to remove the closure assembly from the container, the cooperating ratchet means have to be forcibly moved into a cooperating relationship.

* * * * *